US007734212B2

(12) United States Patent
Miyaji et al.

(10) Patent No.: US 7,734,212 B2
(45) **Date of Patent: *Jun. 8, 2010**

(54) IMAGE FORMING APPARATUS WITH A BRUSH ROLLER THAT ROTATES AND RECIPROCATES

(75) Inventors: Shinki Miyaji, Osaka (JP); Yoshihiko Maruyama, Osaka (JP); Koji Shin, Osaka (JP)

(73) Assignee: Kyocera Mita Corporation (JP)

( * ) Notice: Subject to any disclaimer, the term of this patent is extended or adjusted under 35 U.S.C. 154(b) by 493 days.

This patent is subject to a terminal disclaimer.

(21) Appl. No.: 11/703,376

(22) Filed: Feb. 7, 2007

(65) Prior Publication Data

US 2007/0189801 A1 Aug. 16, 2007

(30) Foreign Application Priority Data

Feb. 10, 2006 (JP) ..... 2006-034272
Apr. 25, 2006 (JP) ..... 2006-120144

(51) Int. Cl.
*G03G 15/02* (2006.01)

(52) U.S. Cl. ..... 399/100

(58) Field of Classification Search ..... 399/100, 399/176, 99

See application file for complete search history.

(56) References Cited

U.S. PATENT DOCUMENTS

| | | | | |
|---|---|---|---|---|
| 4,339,195 | A * | 7/1982 | Gabelman | 399/100 |
| 6,898,396 | B2 * | 5/2005 | Furuki et al. | |
| 7,062,194 | B2 * | 6/2006 | Yanagida et al. | 399/100 |
| 7,515,846 | B2 * | 4/2009 | Miyaji | 399/100 |
| 2003/0039494 | A1 * | 2/2003 | Shakuto et al. | |
| 2003/0175046 | A1 * | 9/2003 | Namiki et al. | 399/176 |
| 2006/0115292 | A1 * | 6/2006 | Sampe et al. | 399/100 |
| 2007/0122180 | A1 * | 5/2007 | Miyaji | 399/100 |

FOREIGN PATENT DOCUMENTS

| | | | |
|---|---|---|---|
| JP | 56104349 | A * | 8/1981 |
| JP | 2005-004065 | | 1/2005 |

* cited by examiner

*Primary Examiner*—Susan S Lee
(74) *Attorney, Agent, or Firm*—Gerald E. Hespos; Michael J. Porco

(57) ABSTRACT

An image forming apparatus is provided with a rotary image bearing member; a charging roller for charging the outer circumferential surface of the image bearing member by rotating in contact with the image bearing member; a brush roller for cleaning adhered matters on the outer circumferential surface of the charging roller by being held in contact with the charging roller due to its own weight and rotating; a driving mechanism for drivingly rotating the brush roller to have a linear velocity difference to the charging roller; and a moving mechanism for reciprocating the brush roller along the longitudinal direction thereof.

20 Claims, 13 Drawing Sheets

IMAGE FORMING APPARATUS WITH A BRUSH ROLLER THAT ROTATES AND RECIPROCATES

BACKGROUND OF THE INVENTION

1. Field of the Invention

The present invention relates to an image forming apparatus such as a printer, a copier, a facsimile machine or a composite apparatus having functions of these apparatuses.

2. Description of the Background Art

An image forming apparatus has been known which is provided with a charging device including a charging roller for charging the outer circumferential surface of a photoconductive drum by synchronously rotating with the photoconductive drum and a brush roller for cleaning toner particles, additives and the like attached to the charging roller by coming into contact with this charging roller substantially from right above. Here, the brush roller comes into contact with the charging roller due to its own weight and is rotated by the charging roller (see, for example, Japanese Unexamined Patent Publication No. 2005-4065).

However, since the brush roller is rotated by the charging roller according to the above background art, it has a weak cleaning force and cannot be expected to have a long life of enduring about several hundred thousands image forming operations. Accordingly, it may be thought to make the brush roller heavier in order to strengthen the cleaning force. However, according to such a measure, there are problems that charging performance is reduced because additives are fixed to the charging roller and jitter images (line images) are likely to be formed because the rotation of the charging roller becomes unstable.

SUMMARY OF THE INVENTION

An object of the present invention is to provide an image forming apparatus designed to prolong the life of the cleaning performance of a brush roller and capable of suppressing the formation of jitter images.

In order to accomplish this object, one aspect of the invention is directed to an image forming apparatus, comprising a rotary image bearing member; a charging roller for charging the outer circumferential surface of the image bearing member by rotating in contact with the image bearing member; a brush roller for cleaning adhered matters on the outer circumferential surface of the charging roller by being held in contact with the charging roller due to its own weight and rotating; a driving mechanism for drivingly rotating the brush roller to have a linear velocity difference to the charging roller; and a moving mechanism for reciprocating the brush roller along the longitudinal direction thereof.

These and other objects, features, aspects and advantages of the present invention will become more apparent upon a reading of the following detailed description and accompanying drawings.

BRIEF DESCRIPTION OF THE DRAWINGS

FIGS. 2A to 2C are views showing a charging roller and a brush roller, wherein FIG. 2A is a side view, FIG. 2B is a front view and FIG. 2C is a side view showing inclined directions of bristles of the brush roller.

DESCRIPTION OF THE PREFERRED EMBODIMENTS

Hereinafter, a best mode for embodying the present invention is described in detail with respect to the accompanying drawings.

Figure 1:
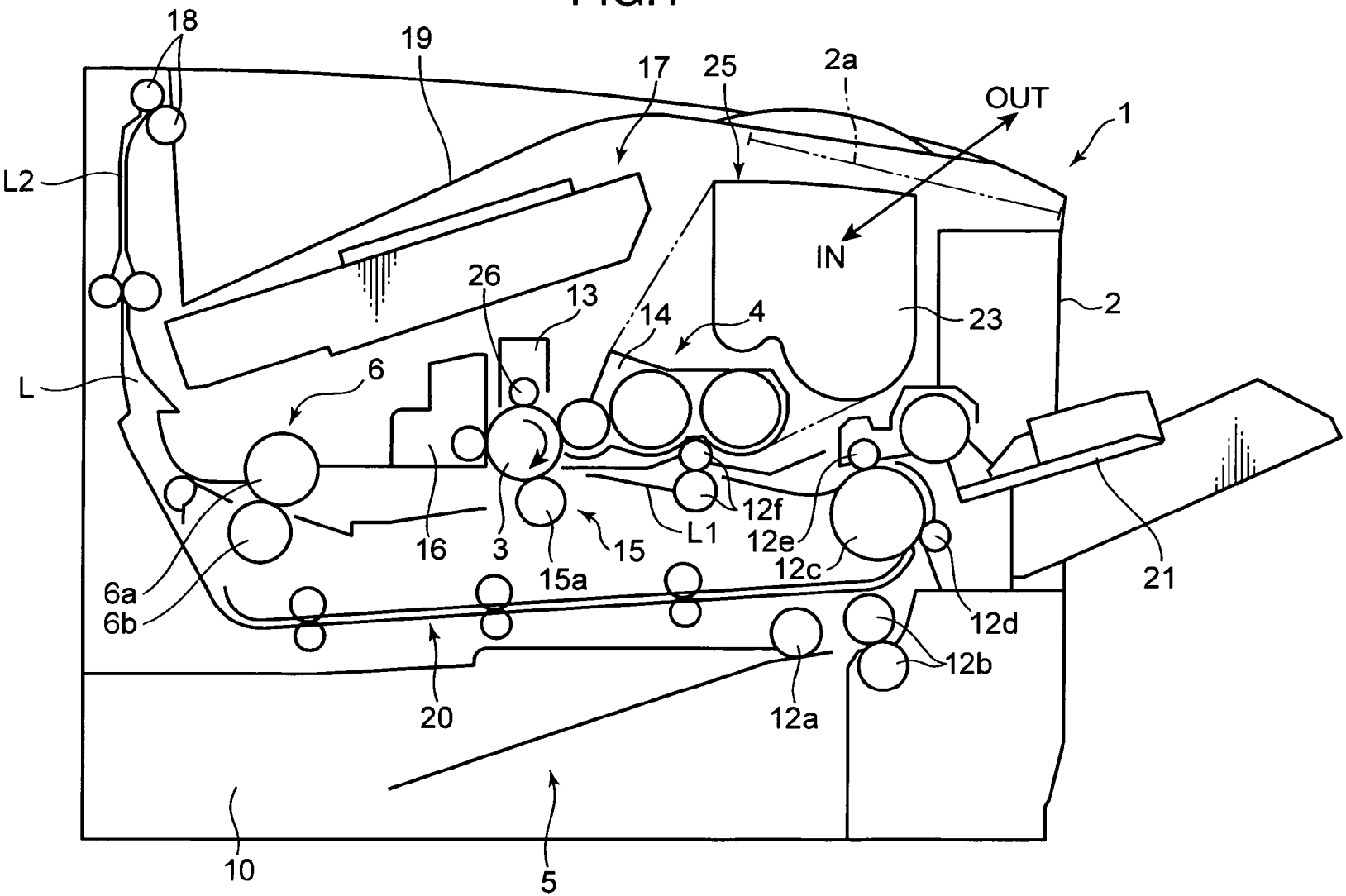
FIG. 1 is a schematic section showing the internal construction of a printer according to one embodiment of the invention.

FIG. 1 is a schematic section of a printer 1 as one example of an image forming apparatus according to one embodiment of the present invention. It should be noted that the present invention is not limitedly applicable to printers, but is also applicable to copiers, facsimile machines, composite apparatuses or other image forming apparatuses.

The printer 1 is for forming an image on a sheet based on an image data transmitted from a terminal unit or the like while conveying the sheet along a conveyance path L. An image forming assembly 4 for transferring a toner image to a sheet after forming the toner image on the outer circumferential surface of a photoconductive drum 3, a sheet feeding assembly 5 for feeding sheets to the image forming assembly 4 and a fixing assembly 6 for fixing the toner image to the sheet are provided in a box-shaped apparatus main body 2.

The conveyance path L is comprised of a horizontal part L1 extending in transverse direction and a vertical part L2 standing up substantially vertically from the left end of the horizontal part L1 in FIG. 1.

The sheet feeding assembly 5 includes a sheet cassette 10 arranged below the horizontal part L1 of the conveyance path L. Sheets accommodated in the sheet cassette 10 are dispensed by a pickup roller 12*a* and fed one by one to the horizontal part L1 of the conveyance path L by feed rollers 12*b* to 12*e*. The sheet fed to the conveyance path L is temporarily caused to wait on standby by registration rollers 12*f* to be fed to the image forming assembly 4 at a specified timing.

The image forming assembly 4 includes the photoconductive drum 3 (one example of an image bearing member) disposed substantially in the middle of the horizontal part L1 of the conveyance path L, a charging device 13 disposed above the photoconductive drum 3, a developing device 14 disposed to the right of the photoconductive drum 3, and a transfer device 15 disposed below the photoconductive drum 3, a cleaning device 16 disposed to the left of the photoconductive drum 3, and a laser scanner unit (LSU) 17 disposed above the charging device 13, the cleaning device 16 and the fixing assembly 6.

The photoconductive drum 3 rotates in clockwise direction in FIG. 1. A laser beam based on the image data is emitted through a clearance between the charging device 13 and the developing device 14 by the laser scanner unit 17 after the outer circumferential surface of the photoconductive drum 3 is uniformly charged by the charging device 13, whereby an electrostatic latent image is formed. Further, toner particles are supplied from the developing device 14 to the outer circumferential surface where the electrostatic latent image is formed, thereby forming a toner image.

The sheet fed from the sheet feeding assembly 5 has the toner image on the outer circumferential surface of the photoconductive drum 3 transferred to the front side (transfer surface) thereof by being conveyed while being pressed against the photoconductive drum 3 by a transfer roller 15*a* of the transfer device 15. Thereafter, the sheet is fed to the fixing assembly 6. It should be noted that the residual toner particles and the residual electric charges on the outer circumferential surface of the photoconductive drum 3 after the image transfer are removed by the cleaning device 16.

The fixing assembly 6 includes a heating roller 6*a* and a pressure roller 6*b*. The toner image transferred to the sheet is fixed to the sheet by heat and pressure given by being held between these rollers 6*a*, 6*b*. The sheet having the toner image fixed thereto is discharged to a discharge portion 19 formed on the upper surface of the apparatus main body 2 by discharge rollers 18.

In the printer 1 of this embodiment, a switchback portion 20 is provided between the horizontal part L1 of the conveyance path L and the sheet cassette 10 so that images can be formed on both surfaces of a sheet. Further, a manual insertion unit 21 is provided at a side wall of the apparatus main body 2.

The developing device 14 and a toner container 23 for replenishing the developing device 14 with toner particles are united into a developing unit 25 and mounted in the printer 1 as such in the shown example. The developing unit 25 is obliquely insertable and withdrawable through an entrance opening 2*a* formed in the upper surface of the apparatus main body 2. Specifically, the developing unit 25 is insertable into the apparatus main body 2 in an obliquely downward direction of arrow IN and withdrawable from the apparatus main body 2 in an obliquely upward direction of arrow OUT.

Figure 2A:
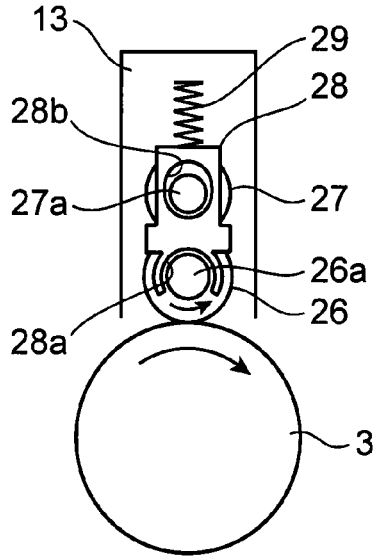
Figure 2B:
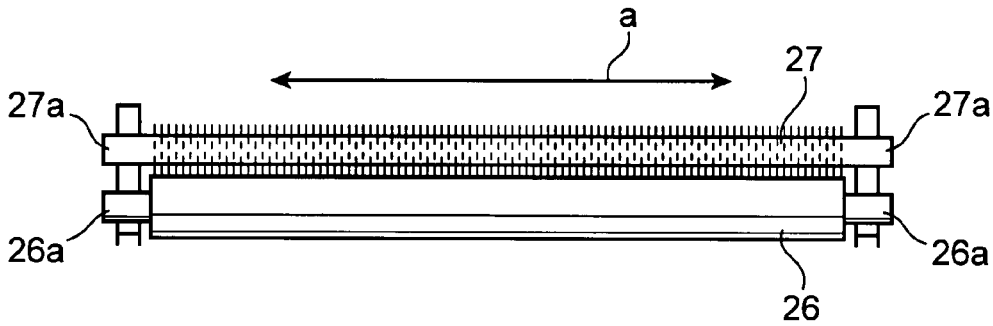
Figure 2C:
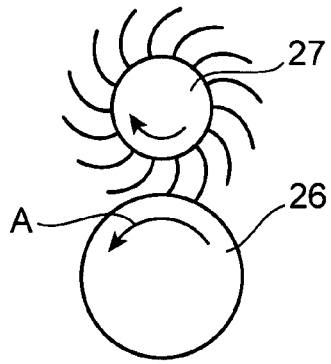

As schematically shown in FIGS. 2A to 2C, the charging device 13 includes a charging roller 26 for charging the outer circumferential surface of the photoconductive drum 3 by synchronously rotating with the photoconductive drum 3, and a brush roller 27 for cleaning the toner particles and adhered matter on the outer circumferential surface of the charging roller 26 by coming into contact with the charging roller 26 substantially from right above. The brush roller 27 is, for example, made of electrically conductive nylon.

Figure 3:
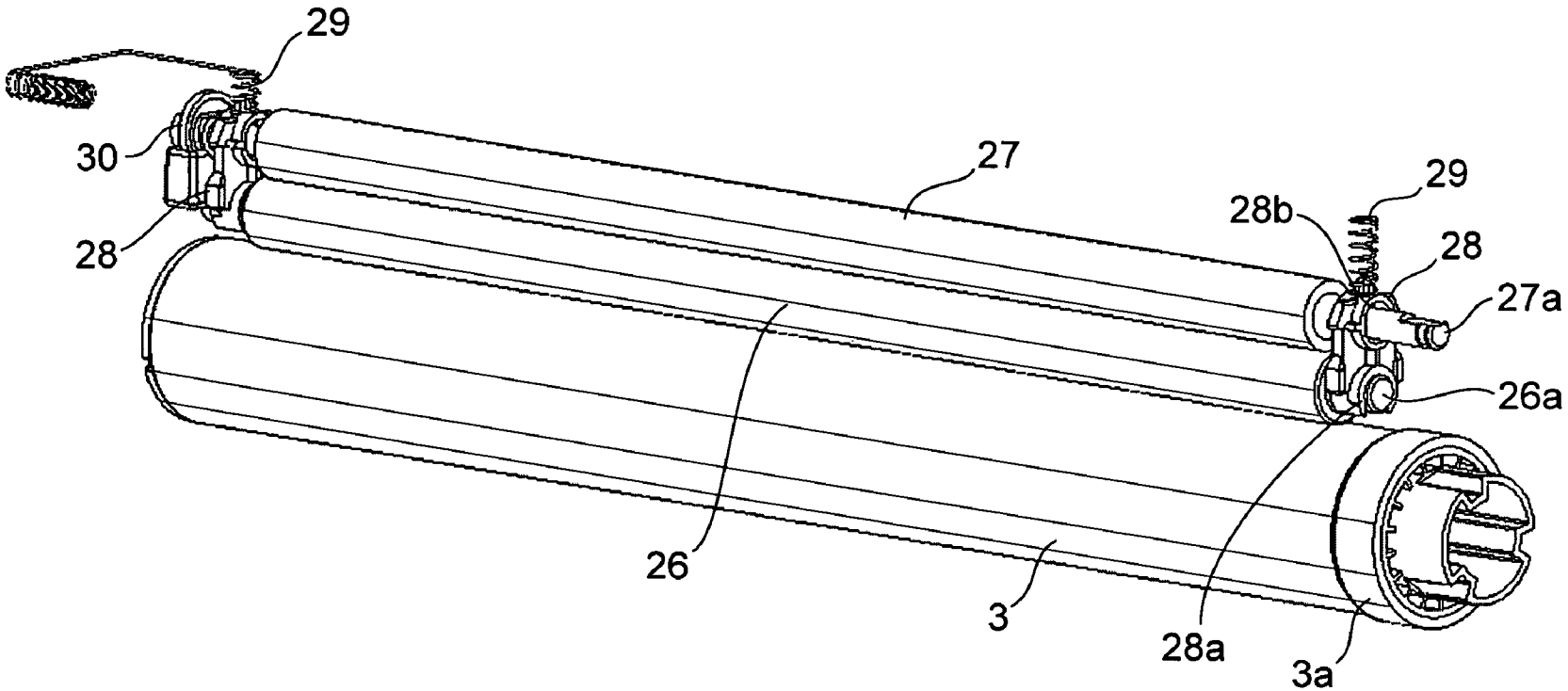
FIG. 3 is a perspective view showing a first assembled state of the charging roller and the brush roller.
Figure 6:
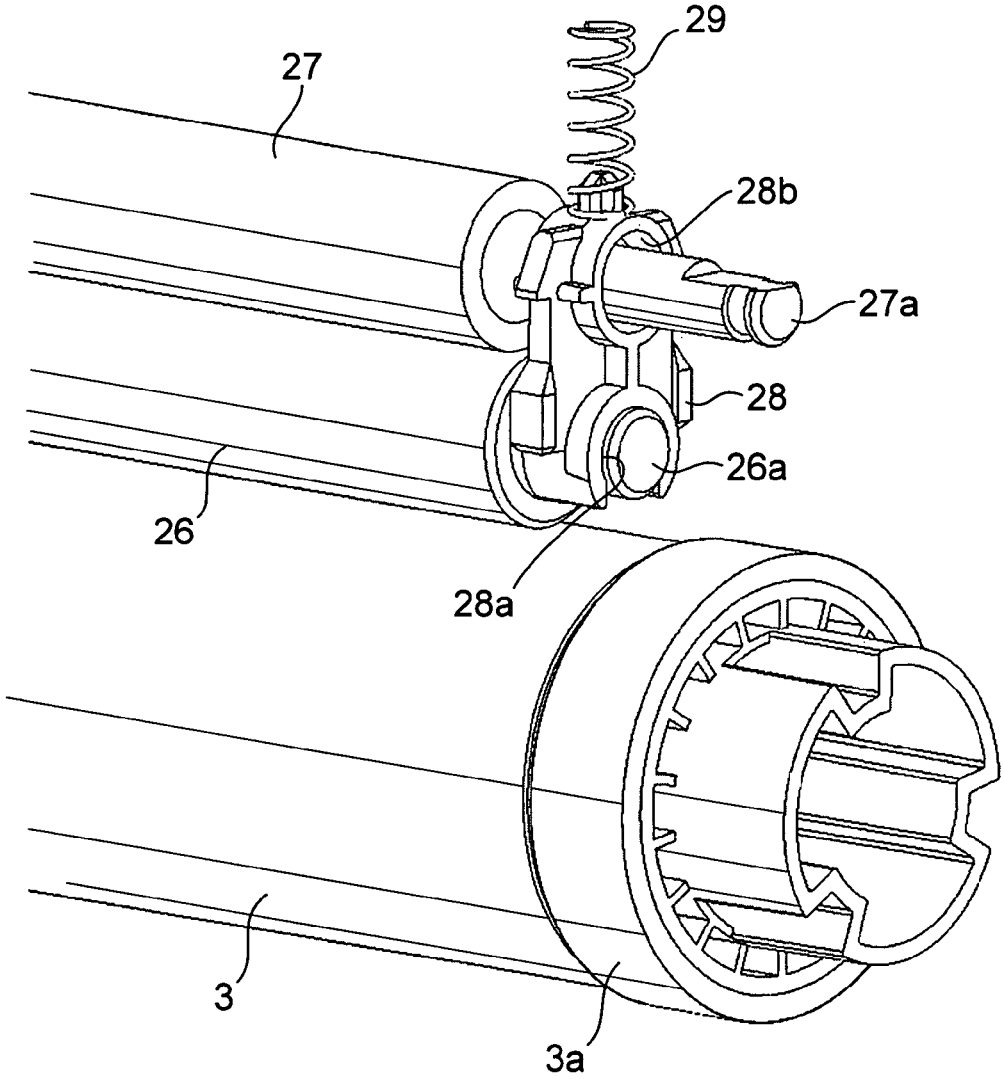
FIG. 6 is an enlarged view of the right side of FIG. 3.
Figure 7:
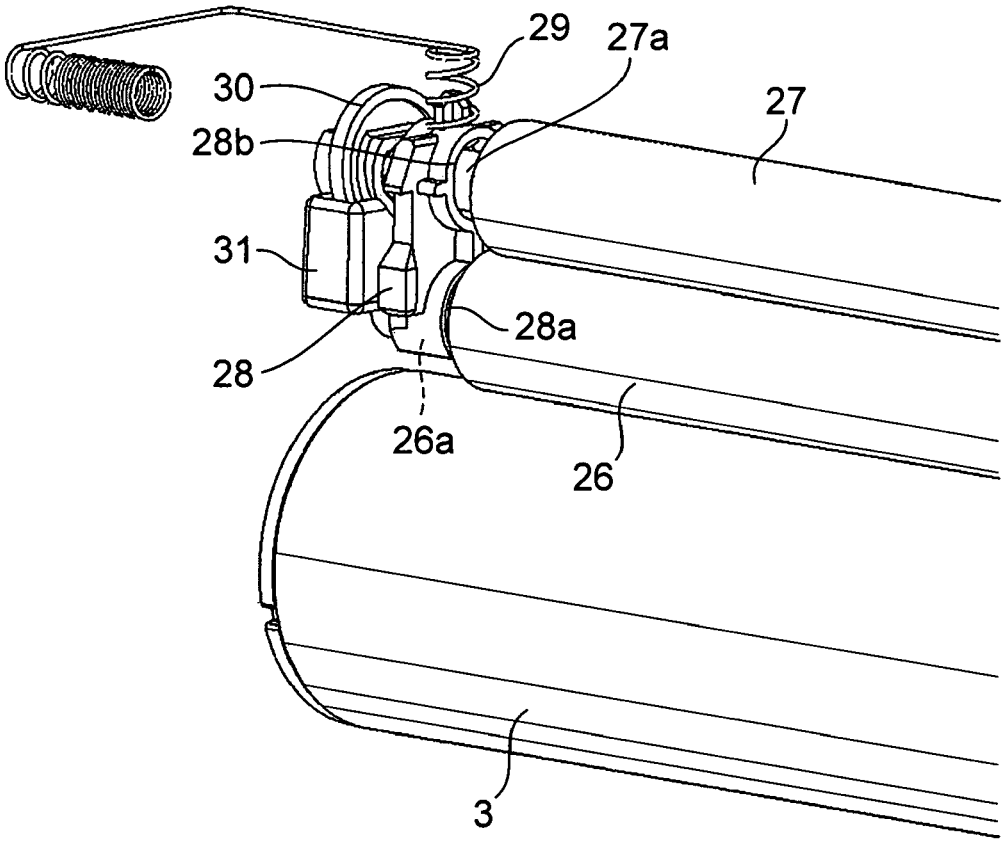
FIG. 7 is an enlarged view of the left side of FIG. 3.

As shown in detail in FIG. 3, FIG. 6, which is an enlarged view of the right side of FIG. 3, and FIG. 7, which is an enlarged view of the left side of FIG. 3, shaft portions 26*a*, 27*a* at the opposite ends of the charging roller 26 and the brush roller 27 are held by bearing members 28. Each bearing member 28 is formed with a shaft hole 28*a* for rotatably holding the corresponding shaft portion 26*a* of the charging roller 26 and an oval shaft hole 28*b* for holding the corresponding shaft portion 27*a* of the brush roller 27 such that this shaft portion 27*a* is rotatable, vertically movable and reciprocally movable along longitudinal direction (see arrow "a" in FIG. 2B).

The respective bearing members 28 are biased downward by springs 29. The charging roller 26 is held in contact with the photoconductive drum 3 by biasing forces of the springs 29 via the respective bearing members 28. The shaft portions 27*a* at the opposite ends of the brush roller 27 are guided by the longer shaft holes 28*b* of the respective bearing members 28, and the brush roller 27 is in contact with the charging roller 26 due to its own weight.

Figure 8:
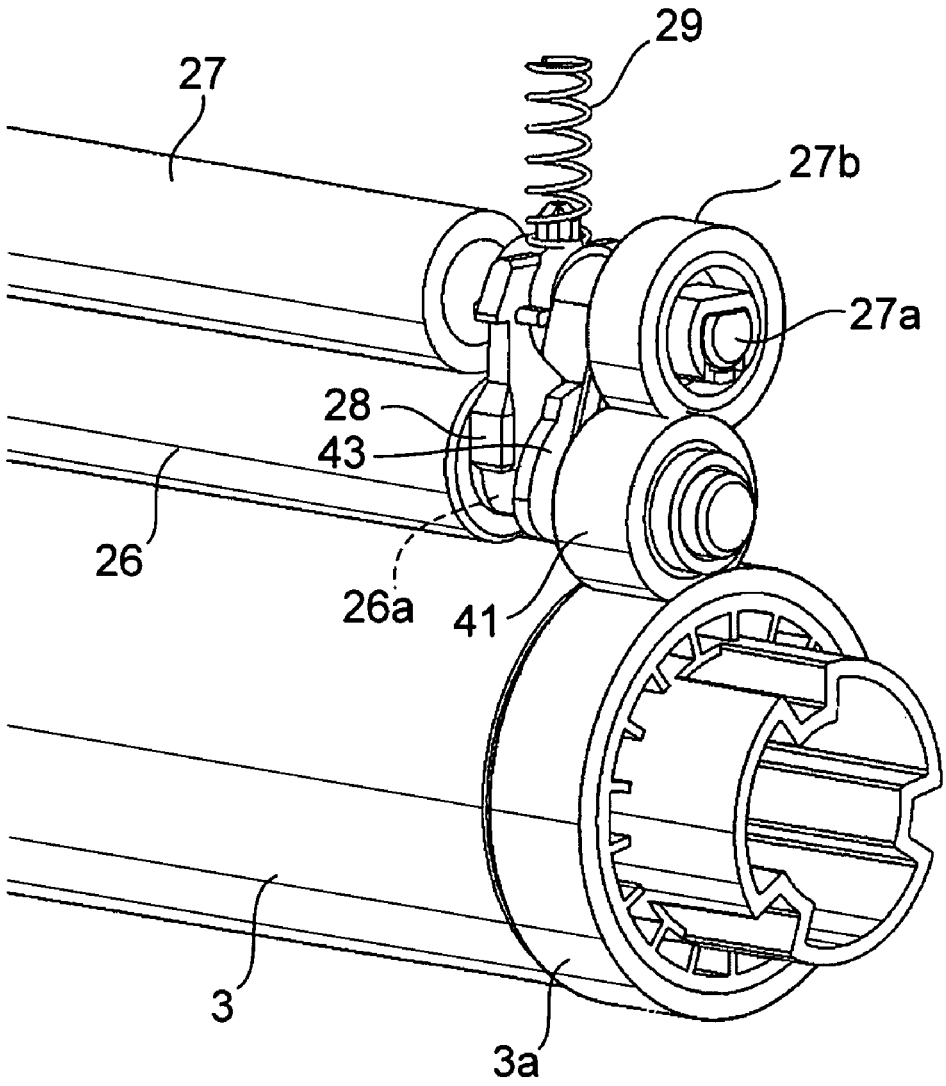
FIG. 8 is an enlarged view showing a state where a gear is assembled in the state of FIG. 6.

As shown in FIG. 8, a gear portion 27*b* (first gear) engaged with a gear portion 3*a* (third gear) of the photoconductive drum 3 via a separate idle gear 41 (second gear) is so mounted on one shaft portion 27*a* as to be concentric with and integral to the brush roller 27.

Specifically, a bracket 43 permitting the rotation of the one shaft portion 27*a* and restricting movements thereof along longitudinal direction is mounted on the one shaft portion 27*a* of the brush roller 27. The idle gear 41 is supported on this bracket 43, and the gear portion 27*b* of the brush roller 27 and the idle gear 41 are constantly kept engaged in a specified state by the bracket 43.

By being held in contact with the photoconductive drum 3 by the biasing forces of the coil springs 29, the charging roller 26 is synchronously rotated with the photoconductive drum 3. Further, by the engagement of the gear portion 27*b* of the brush roller 27 and the gear portion 3*a* of the photoconductive drum 3 via the separate idle gear 41, the brush roller 27 is drivingly rotated while being held in contact with the charging roller 26 due to its own weight.

Vertical movements of the brush roller 27 can be taken up by the depth of engagement of the idle gear 41 vertically moving together with the brush roller 27 via the bracket 43 and the gear portion 3*a* of the photoconductive drum 3. The engaged state of the idle gear 41 and the gear portion 3*a* of the photoconductive drum 3 are adjusted not to be too much or too little by restricting vertical movements of the shaft portions 27*a* at the opposite ends of the brush roller 27 by the longer shaft holes 28*b* of the bearing members 28. Reciprocal movements of the brush roller 27 along longitudinal direction can be taken up by the width of engagement of the idle gear 41 reciprocating together with the brush roller 27 via the bracket 43 and the gear portion 3*a* of the photoconductive drum 3.

The depth and width of engagement of the idle gear 41 and the gear portion 3*a* are so selected that the idle gear 41 and the gear portion 3*a* can be kept engaged even if the brush roller 27 moves along vertical direction and longitudinal direction within specified ranges.

Further, by changing the number of teeth of the gear portion 27*b* and the number of teeth of the idle gear 41, the brush roller 27 can be so drivingly rotated as to have a linear velocity difference to the charging roller 26. The linear velocity difference may be at an acceleration (plus) side or at a deceleration (minus) side, but is better to be at the minus side in terms of cleaning performance. In this embodiment, the linear velocity difference is set at −15%.

The fineness of the bristles of the brush roller 27 is preferably within a range of 1 to 10 T (decitex) and the density thereof is preferably within a range of 150 to 300 kF/inch$^2$. Further, biting amounts of the bristles when the brush roller 27 is most distant from the charging roller 26 are preferably 0.1 mm or less.

As schematically shown in FIG. 2C, inclined directions of the bristles of the brush roller 27 with respect to the charging roller 26 conform to a rotating direction A of the charging roller 26.

Figure 9:
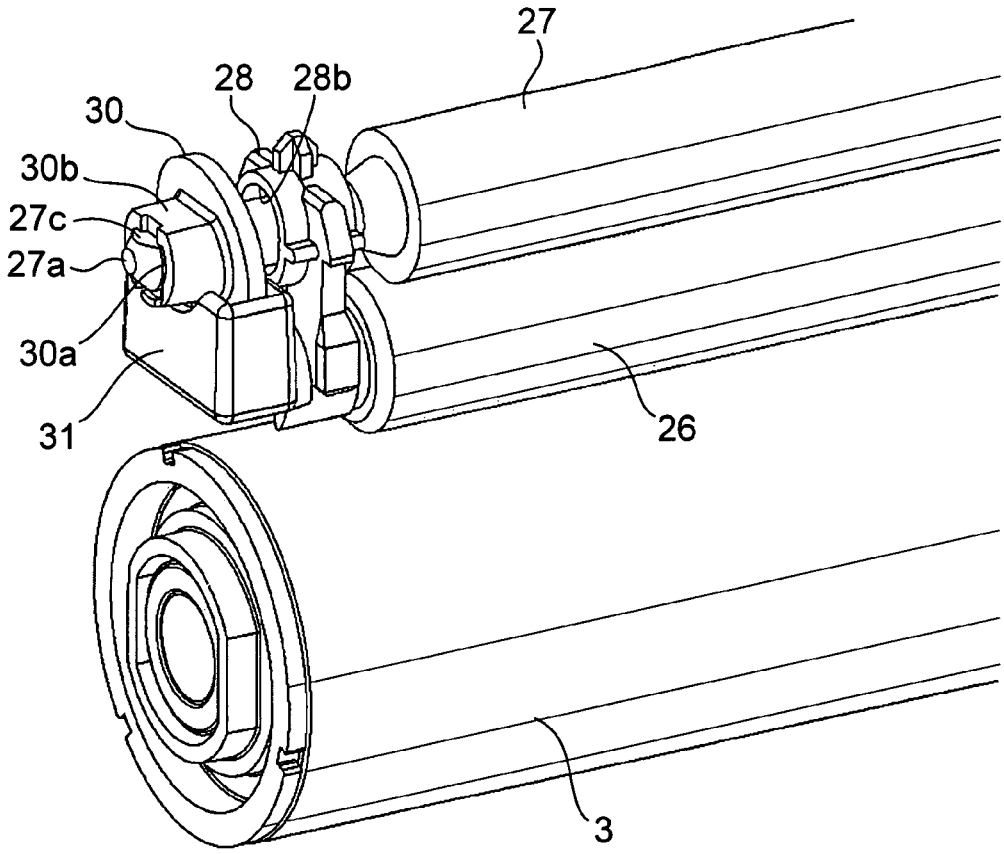
FIG. 9 is a perspective view showing the state of FIG. 7 when viewed from a disk cam side.
Figure 10:
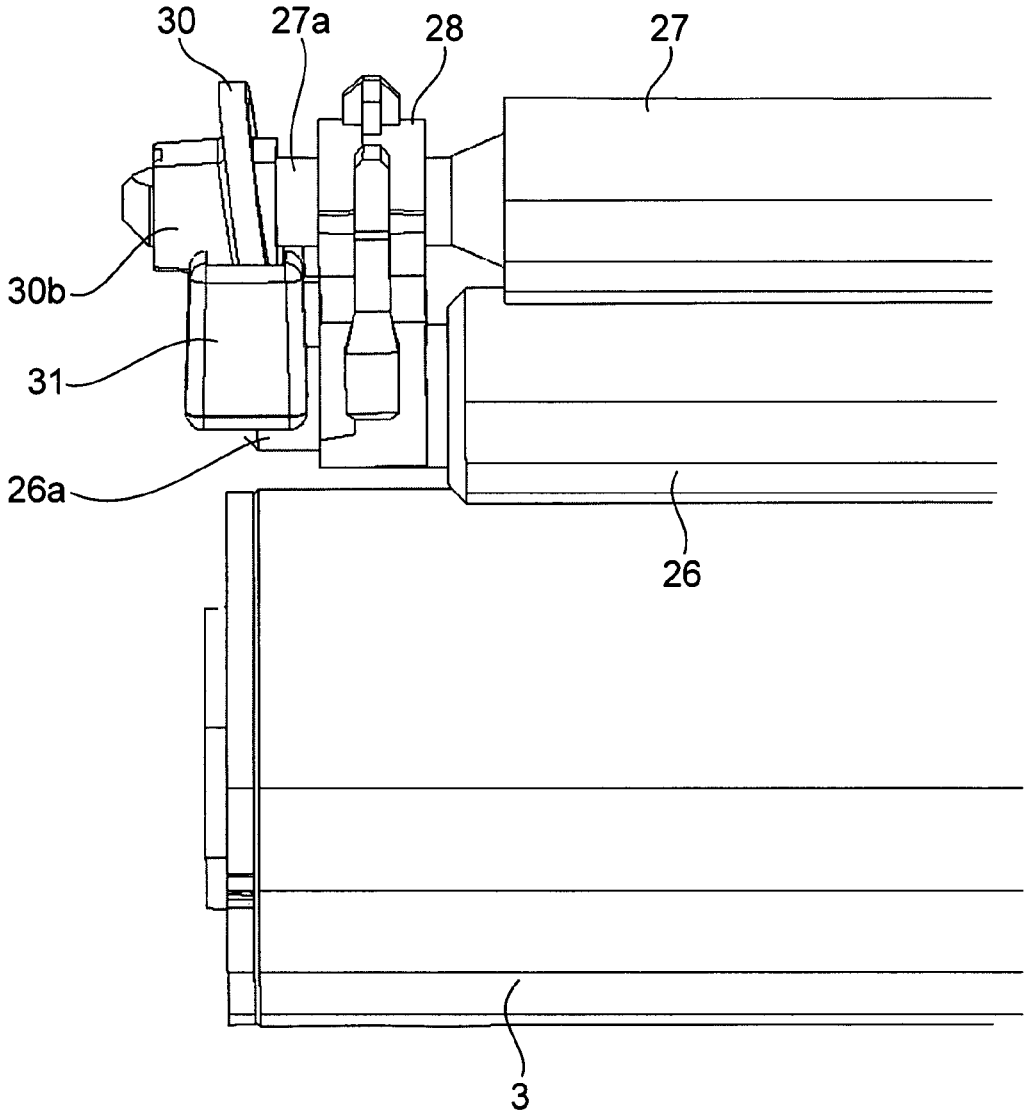
FIG. 10 is a front view showing the state of FIG. 9.
Figure 12A:
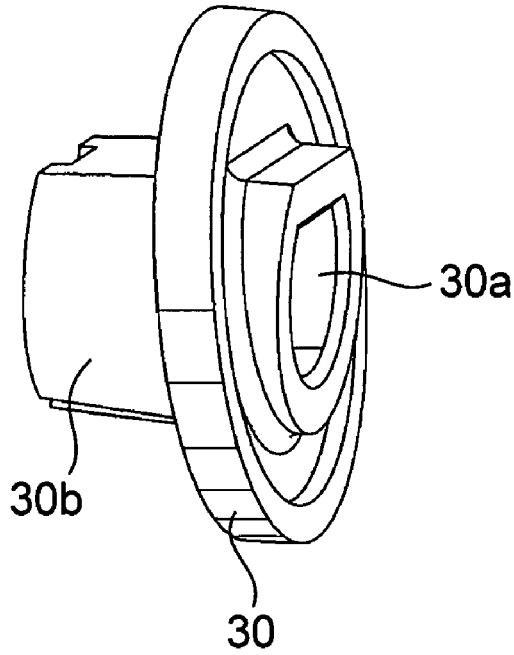
Figure 12B:
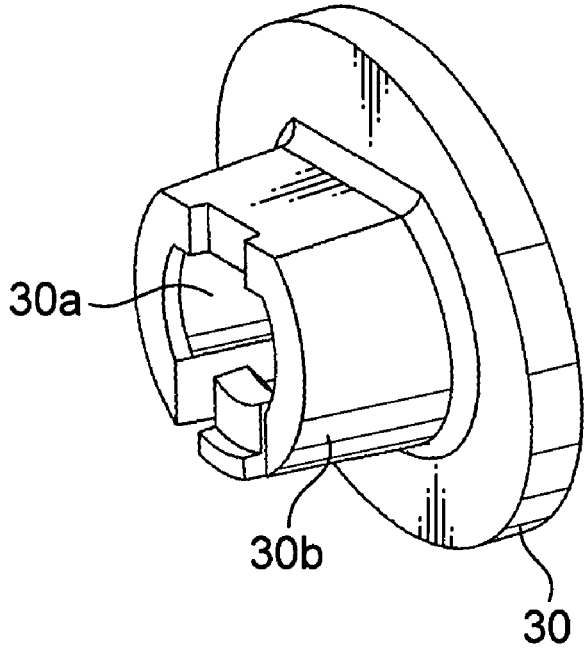

On the other hand, as shown in detail in FIGS. 9 and 10, a disk cam 30 inclined with respect to longitudinal direction is provided on the other shaft portion 27*a* of the brush roller 27. As shown in detail in FIG. 12, this disk cam 30 is integrally provided with a boss portion 30*b* having an oval hole 30*a* unrotatably fittable to an oval portion 27*c* (see FIG. 9) of the other shaft portion 27*a* of the brush roller 27. The disk cam 30 is formed to be slightly inclined with respect to a direction normal to the axis direction of the boss portion 30*b*.

Figure 13A:
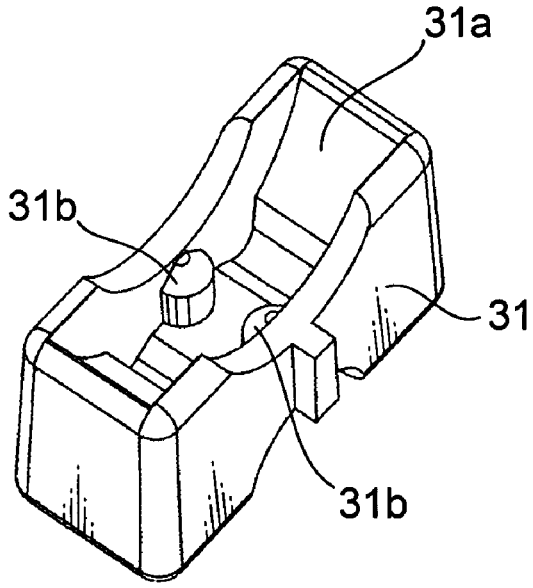
FIGS. 13A and 13B are perspective views of a casing member when viewed from one lateral side and when viewed from the other lateral side, respectively.
Figure 13B:
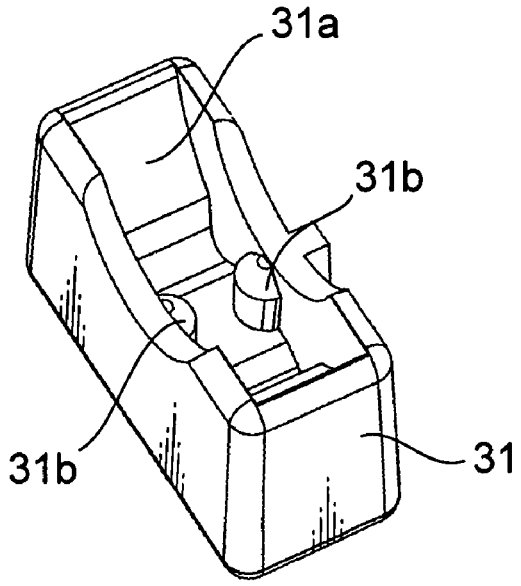

A casing member 31 in the form of a bottomed rectangular box is mounted on a lower part of the disk cam 30. As shown in detail in FIG. 13, a recess 31*a* into which the disk cam 30 is fittable while defining clearances is formed in the casing member 31, and a pair of projections 31*b* for holding a part of the outer periphery of the disk cam 30 from opposite sides along longitudinal direction are formed near the bottom of this recess 31*a*.

Figure 4:
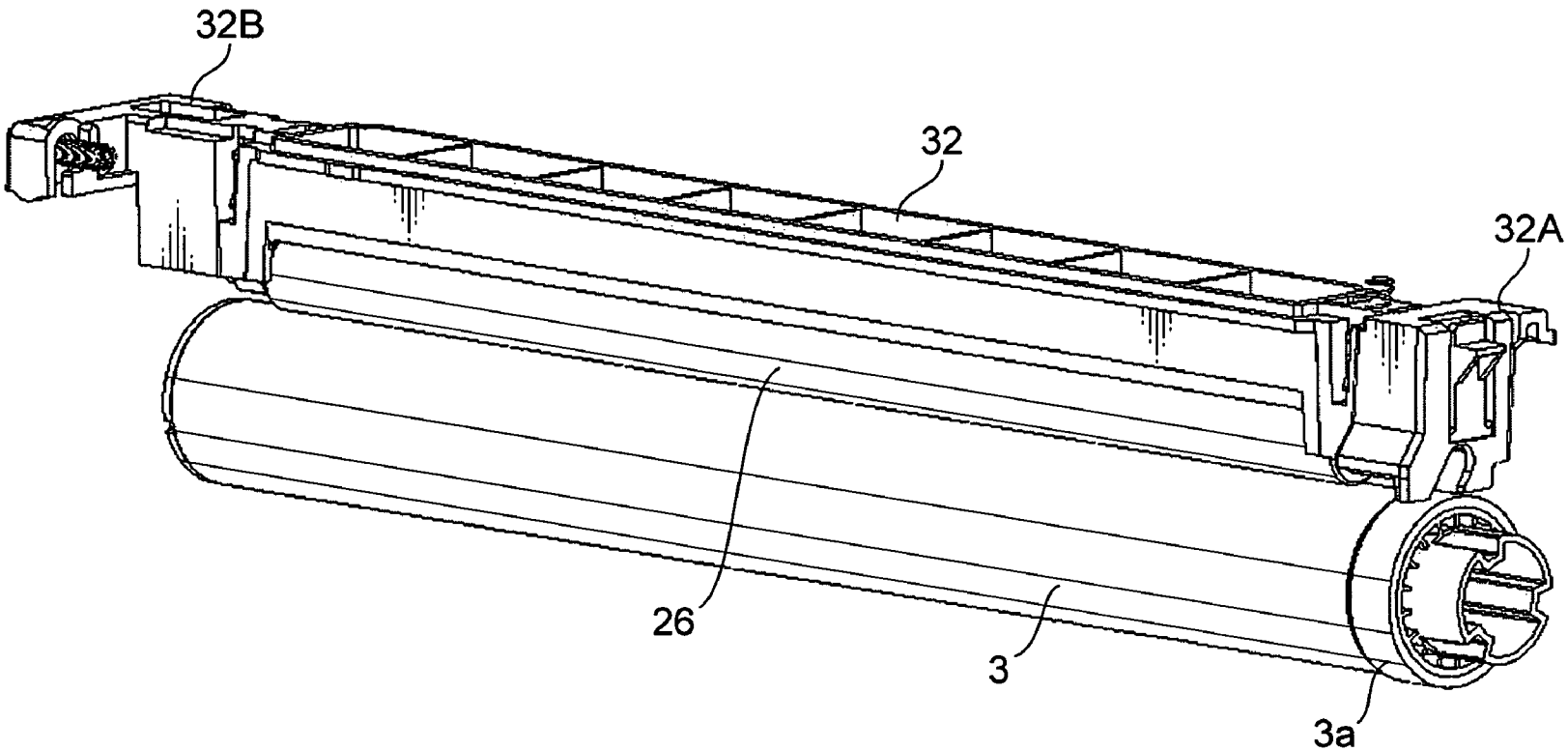
FIG. 4 is a perspective view showing a second assembled state of the charging roller and the brush roller.
Figure 11:
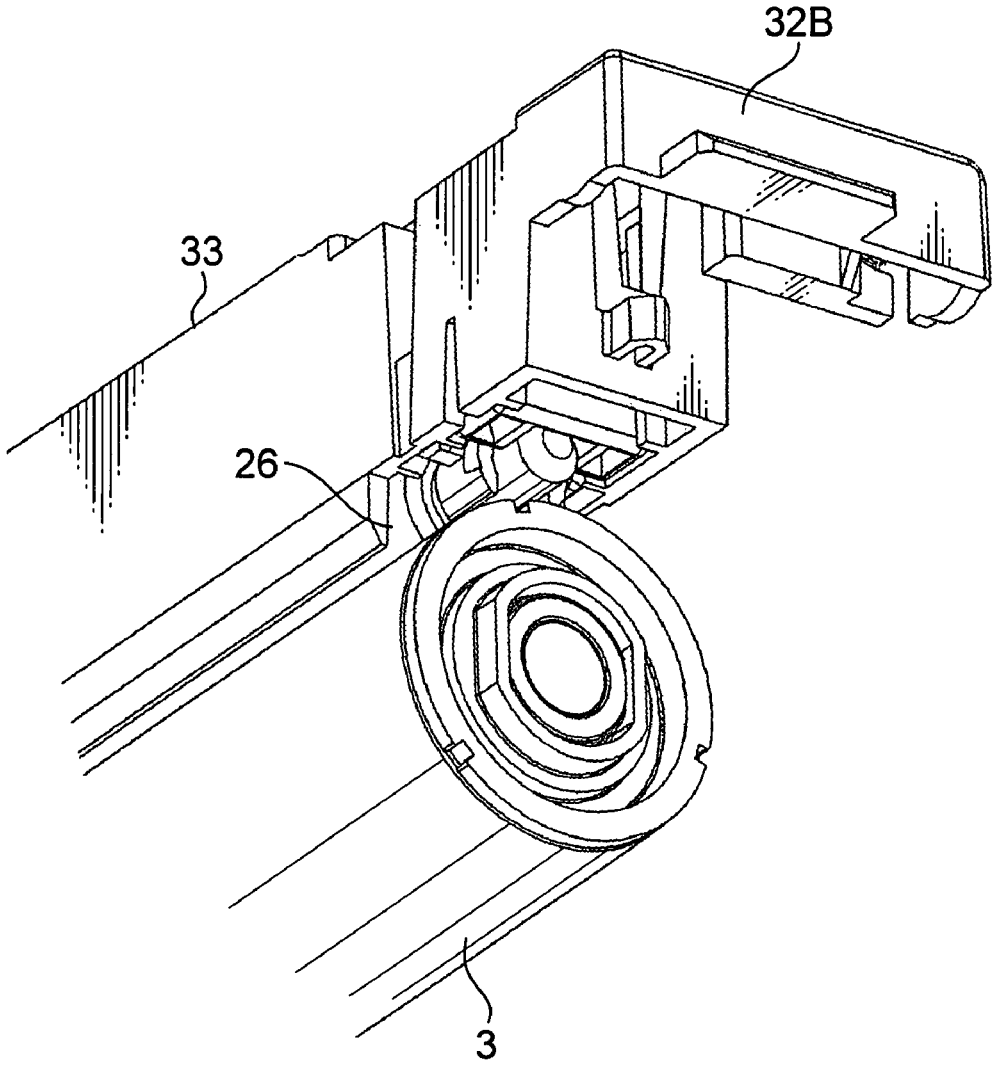
FIG. 11 is a perspective view showing a state where a mounting member is assembled in the state of FIG. 9, FIGS. 12A and 12B are perspective views of the disk cam when viewed from one lateral side and when viewed from the other lateral side, respectively.

As shown in FIG. 4, the bearing members 28 for the shaft portions 26*a*, 27*a* at the opposite ends of the charging roller 26 and the brush roller 27 are supported by box-shaped portions 32A, 32B at the opposite ends of a housing member 32 for the charging roller 26. With reference to FIG. 11, the casing member 31 is so supported in the box-shaped portion 32B of the housing 32 as not to move along longitudinal direction.

Accordingly, when the brush roller 27 is drivingly rotated, the disk cam 30 of the brush roller 27 is guided by the pair of projections 31*b* of the casing member 31 to reciprocate the brush roller 27 along longitudinal direction.

Figure 5:
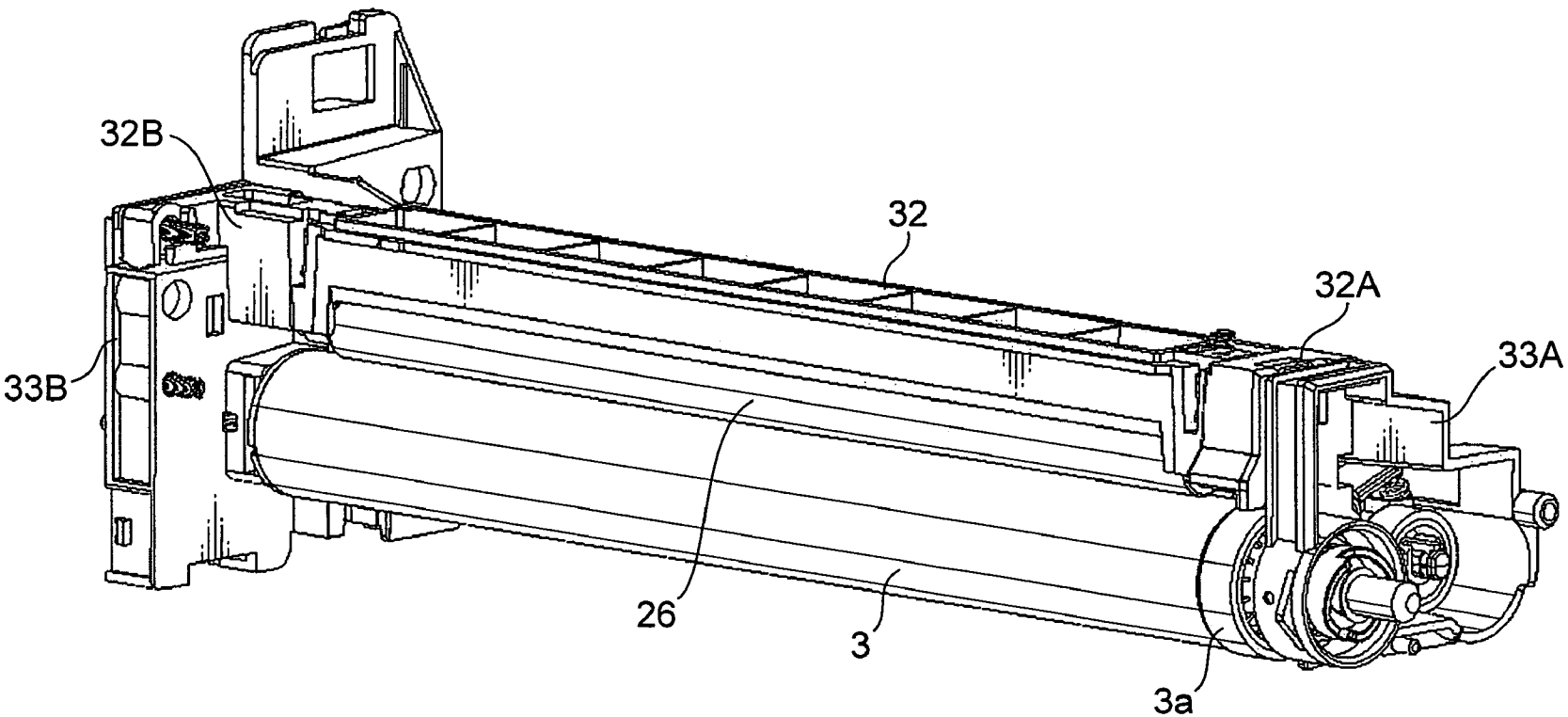
FIG. 5 is a perspective view showing a third assembled state of the charging roller and the brush roller.

As shown in detail in FIG. 5, the box-shaped portions 32A, 32B at the opposite ends of the housing member 32 for the charging roller 26 are fitted with mounting members 33A, 33B, which are mounted on the frame of the apparatus main body 2.

With the above construction, since the brush roller 27 is held in contact with the charging roller 26 due to its own weight in the charging device 13 of the image forming assembly 4, the brush roller 27 can move along the direction normal to the longitudinal direction in conformity with the outer circumferential surface of the charging roller 26 by the presence of the longer shaft holes 28*b* of the bearing members 28, whereby distance between the central axes of the charging roller 26 and the brush roller 27 can be self-adjusted. Accordingly, the brush roller 27 having a high density of bristles can be selected to improve the cleaning performance.

Further, since the brush roller 27 is so drivingly rotated as to have a linear velocity difference to the charging roller 26, the cleaning force can be strengthened. In this case, the brush roller 27 is not made heavier by being rotated using the gear portion 27*b* without being driven by the charging roller 26. Thus, there is no likelihood of adherence of additives to the charging roller 26, wherefore charging performance is more unlikely to decrease. Further, since the rotation of the charging roller 26 becomes more stable, the formation of jitter images is suppressed.

In addition, since the brush roller 27 is reciprocated along longitudinal direction [see arrow "a" in FIG. 2B], clearances between the bristles are automatically filled up (in other words, clearances are completely eliminated). Therefore, the cleaning effect is improved.

TABLE-1 shows experiment results using a type in which the brush roller 27 is drivingly rotated, vertically moved and reciprocated as in this embodiment, a type 1 in which the brush roller 27 is driven, vertically moved and reciprocated, a type 2 in which the brush roller 27 is driven and vertically moved (but not reciprocated) and a type 3 in which the brush roller 27 is drivingly rotated and reciprocated (but not vertically moved), wherein the types 1 to 3 are comparative examples. It should be noted that ○ represents a satisfactory state, for example, free from production of jitter images.

TABLE 1

| | EMBODIMENT | TYPE 1 | TYPE 2 | TYPE 3 |
|---|---|---|---|---|
| State of Brush Roller | Drivingly rotated Vertically moved Reciprocated | Driven Vertically moved Reciprocated | Drivingly rotated Vertically moved | Drivingly rotated Reciprocated |
| Initial Images | ○ | ○ | ○ | Jitter images formed |
| Durability Test Results after 300,000 Copies | ○ | Image error after 60,000 copies | Image error after 120,000 copies | Jitter Images formed |

As is clear from TABLE-1, jitter images were already formed in initial images in the type 3. Image errors in which black points were formed by the adherence of additive aggregate to the charging roller 26 were seen after 60,000 copies in the type 1. Image errors in additives was deposited in lines on the charging roller 26 and linear fogs (jitter images) were formed were seen after 120,000 copies in the type 2. Contrary to these, in the type according to this embodiment, no formation of jitter images was seen even after 300,000 copies.

TABLE-2 shows experiment results using a type in which the biting amount "t" of the bristles of the brush roller 27 is t=0.10 mm, a type 4 in which t=0.05 mm, a type 5 in which t=0.15 and a type 6 in which t=0.20 mm. It should be noted that ○ represents a satisfactory state, for example, free from production of jitter images, ◎ represents a more satisfactory state, Δ represents a permissible state and x represents an impermissible state.

TABLE 2

| | TYPE 4 t = 0.05 | EMBODIMENT t = 0.10 | TYPE 5 t = 0.15 | TYPE 6 t = 0.20 |
|---|---|---|---|---|
| Initial Jitter | ◎ | ○ | Δ | X |
| Cleaning Performance | X | ○ | ○ | ◎ |

As is clear from TABLE-2, no initial jitter (jitter in initial images) was seen, but cleaning performance was degraded in the type 4. Initial jitter was a little seen, but cleaning performance was good in the type 5. Initial jitter of impermissible level was seen, but cleaning performance was good in the type 6. Contrary to these, no initial jitter was seen and cleaning performance was good in the type according to this embodiment.

On the other hand, since only the disk cam 30 and the casing member 31 are provided as a mechanism for reciprocating ("a" in FIG. 2B) the brush roller 27, the reciprocation ("a" in FIG. 2B) can be securely made by a simple construction.

By setting the bristle fineness of the brush roller 27 within the range of 1 to 10 T (decitex) and setting density of the bristles within the range of 150 to 300 kF/inch$^2$, there is less likelihood of adherence of additives to the charging roller 26, wherefore charging performance is unlikely to decrease.

Further, by setting the inclined directions of the bristles of the brush roller 27 in conformity with the rotating direction A of the charging roller 26, areas of contact with the charging roller 26 are increases, wherefore the production of jitter images can be more suppressed.

The embodiment of the present invention is described above, but the present invention is not limited thereto and may be embodied as follows.

The photoconductive drum 3 is illustrated as one example of the image bearing member in the foregoing embodiment. Instead, an image bearing member in the form of a belt may be employed.

The brush roller 27 is arranged substantially right above the charging roller 26 in the foregoing embodiment. Instead, the brush roller 27 may be arranged obliquely above the charging roller 26.

The linear velocity difference between the brush roller 27 and the charging roller 26 is created by a difference in the number of gear teeth in the foregoing embodiment. This is a preferable embodiment in the case of drivingly rotating the brush roller 27 utilizing a driving force of the photoconductive drum 3. Instead, the brush roller 27 may be drivingly rotated by a separate driving source and drive-controlled to differentiate the linear velocity thereof from that of the charging roller 26.

The disk cam is used as a moving mechanism for reciprocating the brush roller 27 along longitudinal direction in the foregoing embodiment. This is only one example, and the brush roller 27 may be thrust using, for example, a crank mechanism or a vibrator.

The aforementioned specific embodiments mainly embrace features of the inventions having the following constructions.

An image forming apparatus according to one aspect of the present invention comprises a rotary image bearing member; a charging roller for charging the outer circumferential surface of the image bearing member by rotating in contact with the image bearing member; a brush roller for cleaning adhered matters on the outer circumferential surface of the charging roller by being held in contact with the charging roller due to its own weight and rotating; a driving mechanism for drivingly rotating the brush roller to have a linear velocity difference to the charging roller; and a moving mechanism for reciprocating the brush roller along the longitudinal direction thereof.

With this construction, the brush roller can be moved along a direction normal to longitudinal direction in conformity with the outer circumferential surface of the charging roller (self-adjustment of distance between the central axes of the brush roller and charging roller) since being held in contact with the charging roller due to its own weight. Accordingly, a high density of bristles can be selected to improve the cleaning effect.

Further, since the brush roller is drivingly rotated to have a linear velocity difference to the charging roller, the cleaning force can be strengthened. In this case, since the brush roller is not made heavier by being drivingly rotated without being driven, there is no likelihood of adherence of additives to the charging roller. Thus, charging performance is unlikely to decrease. Further, the rotation of the charging roller is stabilized to suppress the formation of jitter images.

In addition, since the brush roller is reciprocated along longitudinal direction, clearances between the bristles are automatically filled up (in other words, clearances are completely eliminated). Therefore, the cleaning effect is improved.

In the above construction, it is preferable that bearing members for supporting the brush roller and shaft portions at the opposite ends of the brush roller are further provided, that the brush roller is disposed substantially right above the charging roller, and that the bearing members are formed with longer shaft holes long in vertical direction for holding the shaft portions rotatably, vertically movably and reciprocally movably along longitudinal direction.

With this construction, the brush roller can be easily and securely moved along vertical direction and reciprocated along longitudinal direction.

In the above construction, the driving mechanism preferably includes a first gear concentrically mounted on one end of the brush roller, and a second gear synchronously rotatable with the charging roller, engageable with the first gear and having a different number of teeth than the first gear.

With this construction, the brush roller can be drivingly rotated to have a linear velocity difference to the charging roller utilizing a difference in the number of the teeth of the gears.

In this case, it is preferable that the image bearing member is a photoconductive drum rotatable about its central axis and including a third gear concentrically mounted at one end of the photoconductive drum, the charging roller is synchronously rotatable with the photoconductive drum, and that the third gear is engaged with the second gear.

With this construction, the charging roller rotates at the same linear velocity as the photoconductive drum. On the other hand, the brush roller rotates at a different linear velocity than the charging roller since the first and second gears have different numbers of teeth although the brush roller is drivingly rotated utilizing a driving force of the photoconductive drum. Accordingly, the linear velocity difference between the two rollers can be produced by a simple construction without necessitating a separate driving source.

Further in this case, it is preferable that the second gear moves following the movement of the brush roller and that the depth and width of engagement of the second and third gears are set to take up any movement of the brush roller within a movable range thereof.

With this construction, the driving force can be stably transmitted to the brush roller regardless of the movement of the brush roller.

In the above construction, the moving mechanism preferably includes a disk cam provided at one end of the brush roller and inclined with respect to the longitudinal direction, a casing member having holding projections for holding a part of the outer periphery of the disk cam from opposite sides along longitudinal direction, and a supporting member for supporting the casing member in such a manner as not to permit a movement of the casing member along longitudinal direction.

With this construction, the brush roller can be securely reciprocated by a simple construction since only the disk cam and the casing member are provided as the mechanism for reciprocating the brush roller along longitudinal direction.

In the above construction, the fineness of bristles of the brush roller and the density thereof are preferably set within a range of 1 to 10 T (decitex) and within a range of 150 to 300 kF/inch$^2$, respectively.

With this construction, there is no likelihood of adherence of additives to the charging roller by setting the fineness and density of the bristles of the brush roller within the above ranges. Thus, charging performance is unlikely to decrease.

In the above construction, inclining directions of the bristles of the brush roller with respect to the charging roller conform to a rotating direction of the charging roller.

With this construction, the formation of jitter images can be more suppressed since areas of contact of the bristles with the charging roller are increased.

This application is based on patent application Nos. 2006-034272 and 2006-120144 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

a rotary image bearing member;

a charging roller for charging the outer circumferential surface of the image bearing member by rotating in contact with the image bearing member;

a brush roller for cleaning adhered matters on the outer circumferential surface of the charging roller by being held in contact with the charging roller due to its own weight and rotating;

a driving mechanism for drivingly rotating the brush roller to have a linear velocity difference to the charging roller; and a moving mechanism for reciprocating the brush roller along the longitudinal direction thereof, wherein the driving mechanism includes:

a first gear concentrically mounted on one end of the brush roller, and a second gear synchronously rotatable with the charging roller, engageable with the first gear and having a different number of teeth than the first gear.

2. An image forming apparatus according to claim 1, further comprising:

bearing members for supporting the brush roller, and shaft portions at the opposite ends of the brush roller, wherein the brush roller is disposed substantially right above the charging roller, and the bearing members are formed with longer shaft holes long in vertical direction for holding the shaft portions rotatably, vertically movably and reciprocally movably along longitudinal direction.

3. An image forming apparatus according to claim 1, wherein:

the image bearing member is a photoconductive drum rotatable about its central axis and including a third gear concentrically mounted at one end of the photoconductive drum, the charging roller is synchronously rotatable with the photoconductive drum, and the third gear is engaged with the second gear.

4. An image forming apparatus according to claim 3, wherein:

the second gear moves following the movement of the brush roller, and the depth and width of engagement of the second and third gears are set to take up any movement of the brush roller within a movable range thereof.

5. An image forming apparatus according to claim 1, wherein the moving mechanism includes:

a disk cam provided at one end of the brush roller and inclined with respect to a longitudinal direction, a casing member having holding projections for holding a part of the outer periphery of the disk cam from opposite sides along longitudinal direction, and a supporting member for supporting the casing member in such a manner as not to permit a movement of the casing member along longitudinal direction.

6. An image forming apparatus according to claim 1, wherein the fineness of bristles of the brush roller and the density thereof are preferably set within a range of 1 to 10 T (decitex) and within a range of 150 to 300 kF/inch$^2$, respectively.

7. An image forming apparatus according to claim 1, wherein inclining directions of bristles of the brush roller with respect to the charging roller conform to a rotating direction of the charging roller.

8. An image forming apparatus according to claim 1, wherein:

the image bearing member is a photoconductive drum rotatable about its central axis and including a third gear concentrically mounted at one end of the photoconductive drum, the charging roller is synchronously rotatable with the photoconductive drum, and the third gear is engaged with the second gear.

9. An image forming apparatus according to claim 8, wherein:

the second gear moves following the movement of the brush roller, and the depth and width of engagement of the second and third gears are set to take up any movement of the brush roller within a movable range thereof.

10. An image forming apparatus, comprising:

a rotary image bearing member;

a charging roller for charging the outer circumferential surface of the image bearing member by rotating in contact with the image bearing member;

a brush roller for cleaning adhered matters on the outer circumferential surface of the charging roller by being held in contact with the charging roller due to its own weight and rotating;

a driving mechanism for drivingly rotating the brush roller to have a linear velocity difference to the charging roller; and a moving mechanism for reciprocating the brush roller along the longitudinal direction thereof, wherein the moving mechanism includes a disk cam provided at one end of the brush roller and inclined with respect to a longitudinal direction, a casing member having holding projections for holding a part of the outer periphery of the disk cam from opposite sides along longitudinal direction, and a supporting member for supporting the casing member in such a manner as not to permit a movement of the casing member along longitudinal direction.

11. An image forming apparatus according to claim 10, further comprising:

bearing members for supporting the brush roller, and shaft portions at the opposite ends of the brush roller, wherein the brush roller is disposed substantially right above the charging roller, and the bearing members are formed with longer shaft holes long in vertical direction for holding the shaft portions rotatably, vertically movably and reciprocally movably along longitudinal direction.

12. An image forming apparatus according to claim 11, wherein the driving mechanism includes:

a first gear concentrically mounted on one end of the brush roller, and a second gear synchronously rotatable with the charging roller, engageable with the first gear and having a different number of teeth than the first gear.

13. An image forming apparatus according to claim 12, wherein:

the image bearing member is a photoconductive drum rotatable about its central axis and including a third gear concentrically mounted at one end of the photoconductive drum, the charging roller is synchronously rotatable with the photoconductive drum, and the third gear is engaged with the second gear.

14. An image forming apparatus according to claim 13, wherein:

the second gear moves following the movement of the brush roller, and the depth and width of engagement of the second and third gears are set to take up any movement of the brush roller within a movable range thereof.

15. An image forming apparatus according to claim 10, wherein the fineness of bristles of the brush roller and the density thereof are preferably set within a range of 1 to 10 T (decitex) and within a range of 150 to 300 kF/inch$^2$, respectively.

16. An image forming apparatus according to claim 10, wherein inclining directions of bristles of the brush roller with respect to the charging roller conform to a rotating direction of the charging roller.

17. An image forming apparatus, comprising:

a rotary image bearing member;

a charging roller for charging the outer circumferential surface of the image bearing member by rotating in contact with the image bearing member;

a brush roller for cleaning adhered matters on the outer circumferential surface of the charging roller by being held in contact with the charging roller due to its own weight and rotating;

a driving mechanism for drivingly rotating the brush roller to have a linear velocity difference to the charging roller; and a moving mechanism for reciprocating the brush roller along the longitudinal direction thereof, wherein the fineness of bristles of the brush roller and the density thereof are preferably set within a range of 1 to 10 T (decitex) and within a range of 150 to 300 kF/inch$^2$, respectively.

18. An image forming apparatus according to claim 17, further comprising:

bearing members for supporting the brush roller, and shaft portions at the opposite ends of the brush roller, wherein the brush roller is disposed substantially right above the charging roller, and the bearing members are formed with longer shaft holes long in vertical direction for holding the shaft portions rotatably, vertically movably and reciprocally movably along longitudinal direction.

19. An image forming apparatus according to claim 18, wherein the driving mechanism includes:

a first gear concentrically mounted on one end of the brush roller, and a second gear synchronously rotatable with the charging roller, engageable with the first gear and having a different number of teeth than the first gear.

20. An image forming apparatus according to claim 17, wherein the moving mechanism includes:

a disk cam provided at one end of the brush roller and inclined with respect to a longitudinal direction, a casing member having holding projections for holding a part of the outer periphery of the disk cam from opposite sides along longitudinal direction, and a supporting member for supporting the casing member in such a manner as not to permit a movement of the casing member along longitudinal direction.

* * * * *